United States Patent [19]

Augustin

[11] Patent Number: 4,539,017

[45] Date of Patent: Sep. 3, 1985

[54] ELASTIC GRINDING ELEMENT AND METHOD FOR PRODUCING IT

[75] Inventor: Rainer Augustin, Birkenfeld, Fed. Rep. of Germany

[73] Assignee: SEA Schleifmittel Entwicklung Anwendung GmbH, Pforzheim, Fed. Rep. of Germany

[21] Appl. No.: 496,955

[22] Filed: May 18, 1983

[30] Foreign Application Priority Data

May 25, 1982 [DE] Fed. Rep. of Germany ..... 3219567

[51] Int. Cl.[3] ..... B24D 11/00

[52] U.S. Cl. ..... 51/293; 51/295

[58] Field of Search ..... 51/293, 295

[56] References Cited

U.S. PATENT DOCUMENTS

| | | | |
|---|---|---|---|
| 2,001,911 | 5/1935 | Wooddell et al. | 51/439 |
| 2,143,636 | 1/1939 | Tone | 51/207 |
| 3,850,589 | 11/1974 | Charvat | 51/296 |
| 3,997,302 | 12/1976 | Supkis | 51/295 |

FOREIGN PATENT DOCUMENTS

| | | |
|---|---|---|
| 0004454 | 10/1979 | European Pat. Off. . |
| 2230963 | 7/1974 | Fed. Rep. of Germany . |
| 2931695 | 2/1981 | Fed. Rep. of Germany . |
| 730774 | 8/1932 | France . |
| 1150880 | 1/1958 | France . |
| 1383274 | 11/1964 | France . |
| 2138739 | 1/1973 | France . |
| 2340711 | 3/1976 | France . |
| 622887 | 5/1949 | United Kingdom . |

*Primary Examiner*—Paul Lieberman
*Assistant Examiner*—Willie Thompson
*Attorney, Agent, or Firm*—Spencer & Frank

[57] ABSTRACT

An elastic grinding element for form-true grinding including a supporting layer of elastomer material and an adhesive grit layer bound to the supporting layer and having an active grinding surface made of a hardened mixture of binder and abrasive grit. The process for making the grinding element includes providing a mold having a shape constructed to produce a desired shape for the grinding element, putting the mixture of binder and abrasive grit and the elastomer material in the mold, and accelerating the mixture of binder and abrasive grit and the elastomer material while in the mold.

10 Claims, 14 Drawing Figures

FIG. 1
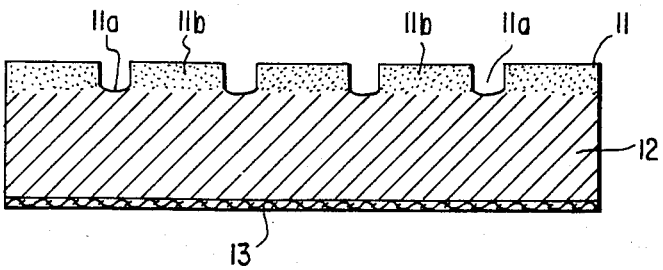
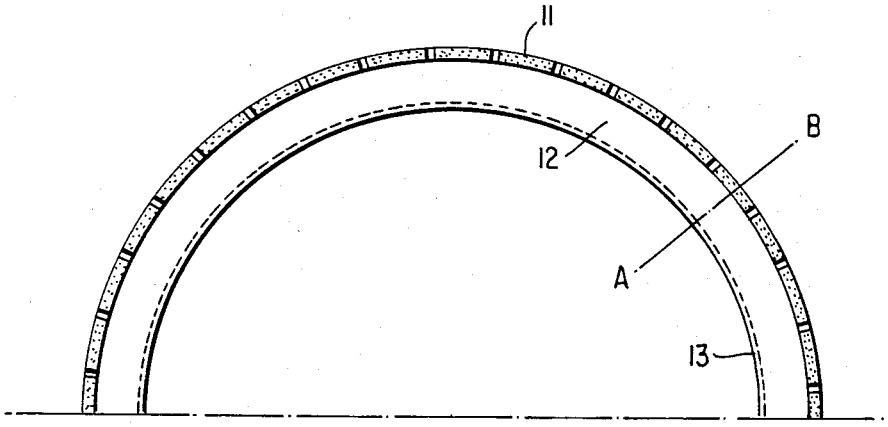
FIG. 2
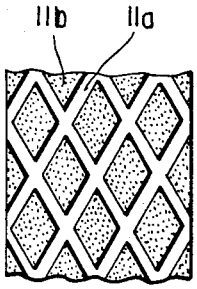
FIG. 3
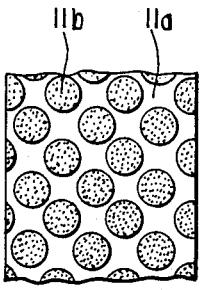
FIG. 4
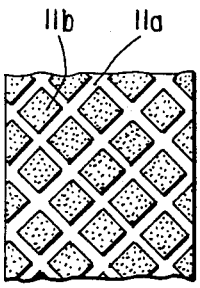
FIG. 5
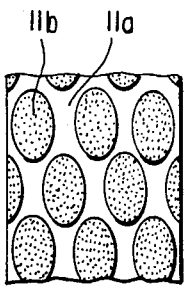
FIG. 6

FIG. 9
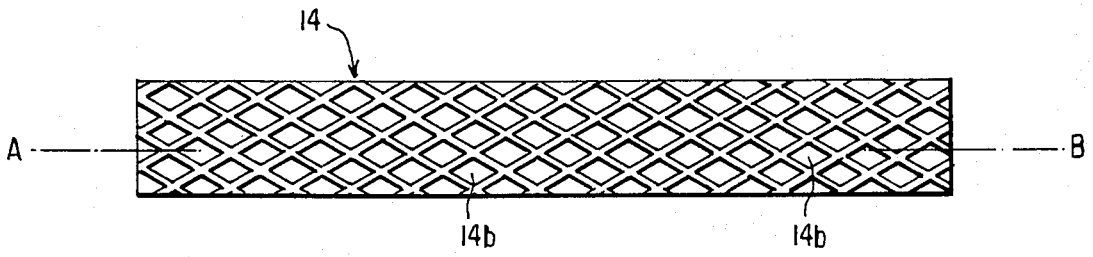
FIG. 10
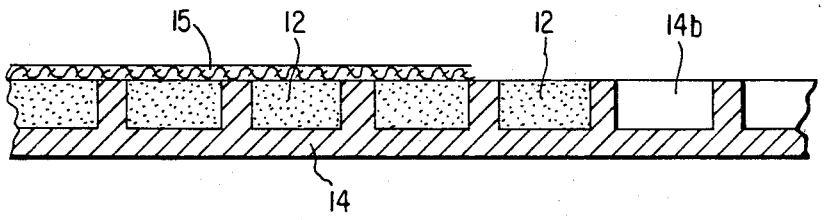
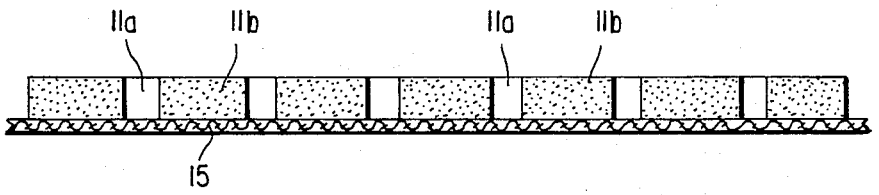
FIG. 11

FIG. 12
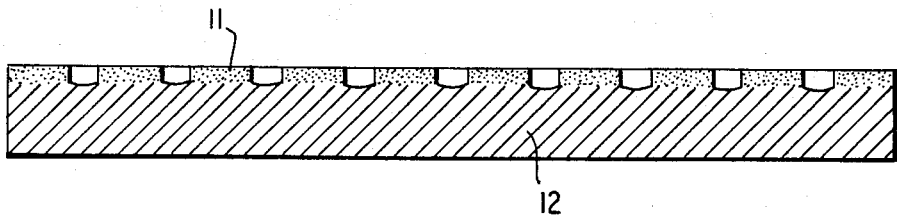
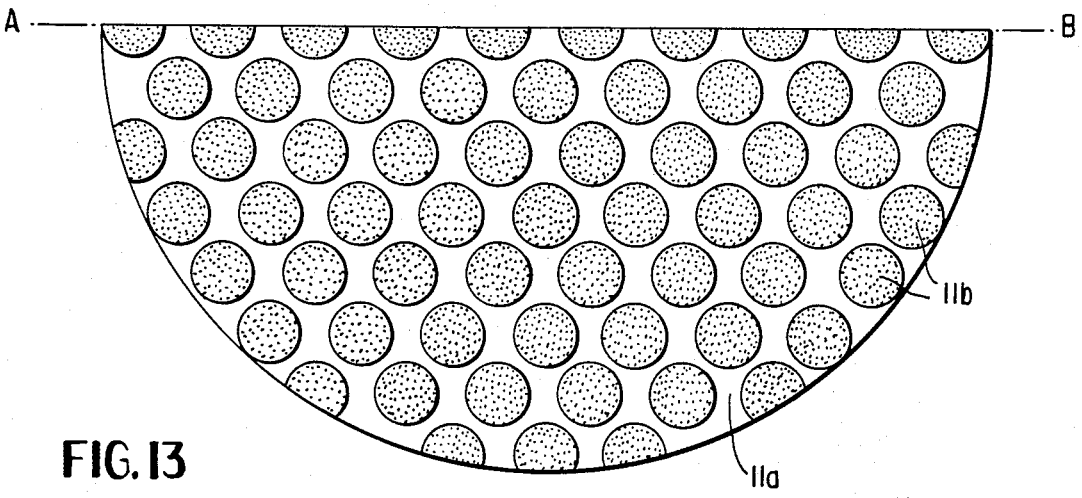
FIG. 13
FIG. 14
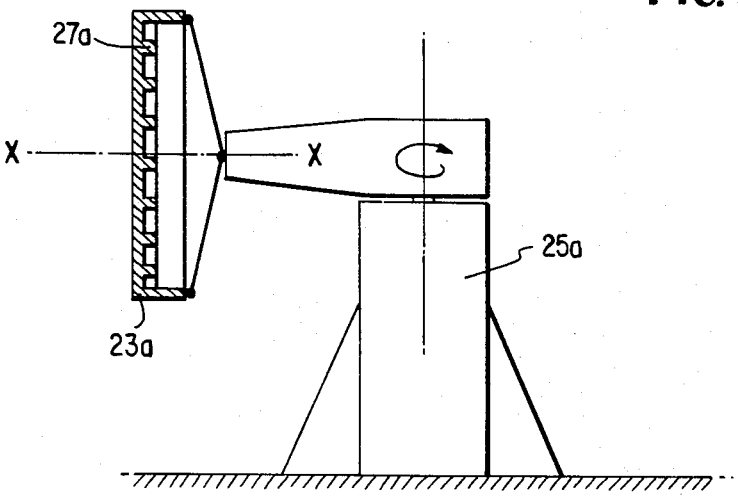

ELASTIC GRINDING ELEMENT AND METHOD FOR PRODUCING IT

BACKGROUND OF THE INVENTION

The present invention relates to an elastic grinding element for form-true grinding or sanding having an abrasive surface covered with abrasive grit, wherein an elastic material comprises part of the volume of the grinding element. The invention also relates to a method for producing such a grinding element.

A known grinding element of the above-mentioned type is provided with a statistical distribution of abrasive grit embedded in an elastomer and, usually, a foamed binder. The individual abrasive grains in this known grinding element tend to escape the grinding pressure exerted by the workpiece being worked on by rotating and tilting movements permitted by their elastically yielding support. No noticeable machining output can be realized with such a grinding element. It is therefore used primarily for finishing work for which it is excellently suited.

An improvement in the above grinding element has been brought about in that rather than "individually" embedding the abrasive grain it is embedded in hard bound composites, that is conglomerates having a thickness of 3–5 mm. These conglomerates "float" in a spaced relationship in the elastic material. Due to the larger dimensions in the geometric configuration of the conglomerates, the abrasive grain cannot escape or tilt out of the way under the grinding pressure exerted by the workpiece. Such a grinding element has considerable advantages but is expensive to manufacture and is not suitable for grinding with oil-containing coolants since the elastomer employed as the elastic material begins to swell between the conglomerates. Even with pure water or fully synthetic coolants, the elastomer swells in the region of the finest grains due to the very slight abrasive work and thus low wear on the grinding elements.

In addition to grinding elements of the above type, where the elastic material is a component of the grinding element, it is also known to use a grinding belt where the necessary elasticity is obtained by means of a more or less resilient contact roller over which the grinding belt travels. In spite of considerable improvements made within recent years, grinding belts still have the drawback that their machining output decreases with increasing use and the resulting roughness height of the belt decreases considerably. For this reason, grinding belts cannot be used at all in some fields.

Grinding elements in the form of laminae, which have been known for a long time, do not have the specific drawbacks of grinding belts but again have a considerably lower machining output connected with considerably increased production, resulting in higher grinding costs.

Finally there are presently in use laminated leather or felt elements which are coated with a mixture of grit and glue, but these are difficult to manufacture, depend on climate and have other drawbacks.

SUMMARY OF THE INVENTION

It is therefore an object of the present invention to provide an elastic grinding element suitable for all industrial applications which exhibits a more favorable ratio between service life (i.e., period of use) and manufacturing costs (production costs) than the prior art solutions.

The above and other objects are accomplished according to the invention by the provision of an elastic grinding element for form-true grinding which includes a supporting layer of elastomer material and an adhesive grit layer bound to the supporting layer and having an active grinding surface made of a hardened mixture of binder and abrasive grit.

A grinding element configured according to the invention combines a service life lying approximately between the service lives of a grinding belt and of the known conglomerate disc with a machining output that is uniformly high during the period of use while maintaining a uniform roughness height. The grinding element according to the invention is further distinguished in that it remains uninfluenced by coolants, even if grinding is effected with different coolants. It is entirely independent of climatic fluctuation and it can be produced economically with consistent quality.

The process according to the invention for producing the elastic grinding element of the invention provides that the mixture of binder and abrasive grit, and the elastomer forming the supporting layer are accelerated under the influence of a force in a mold which determines the final shape of the grinding element. According to one aspect of the inventive process the mixtures employed for producing the grinding element are applied to the mold in succession under the influence of the force.

In order to produce the acceleration, the present invention proposes the use of a centrifugal force in a rotating system which holds the mold containing the mixture of binder and abrasive grit and the mixture of elastomer material and under whose influence the two mixtures are applied to the mold.

With this process and suitable structural design of the centrifuge employed, it is possible to produce elastic grinding elements in the geometric shapes required in practice, for example in the form of a grinding dish, disc or wheel.

BRIEF DESCRIPTION OF THE DRAWINGS

FIG. 1 is a cross-sectional view of an elastic grinding element according to the present invention seen in the plane A-B of FIG. 2.

FIG. 2 is an end elevational view of one half of the elastic grinding element according to the invention.

FIGS. 3 to 6 are partial elevational views of the surface of the grinding element according to FIGS. 1 and 2 showing various designs of the active grinding surface.

FIG. 9 is a total elevational view of a planar negative mold.

FIG. 10 ist a partial cross-sectional view (A-B) of a carrier strip with grinding humps as it is formed in the mold of FIG. 9.

FIG. 11 is a partial cross-sectional view of the carrier strip of FIGS. 9/10, removed from the mold.

FIG. 12 is a partial elevational view of a disc-shaped grinding element.

FIG. 13 is a cross-sectional view (A-B) of the grinding element of FIG. 12.

FIG. 14 is a schematic elevational side view of a centrifuge used for the production of disc-shaped grinding elements when rotating.

DESCRIPTION OF THE PREFERRED EMBODIMENTS

Figure 7:
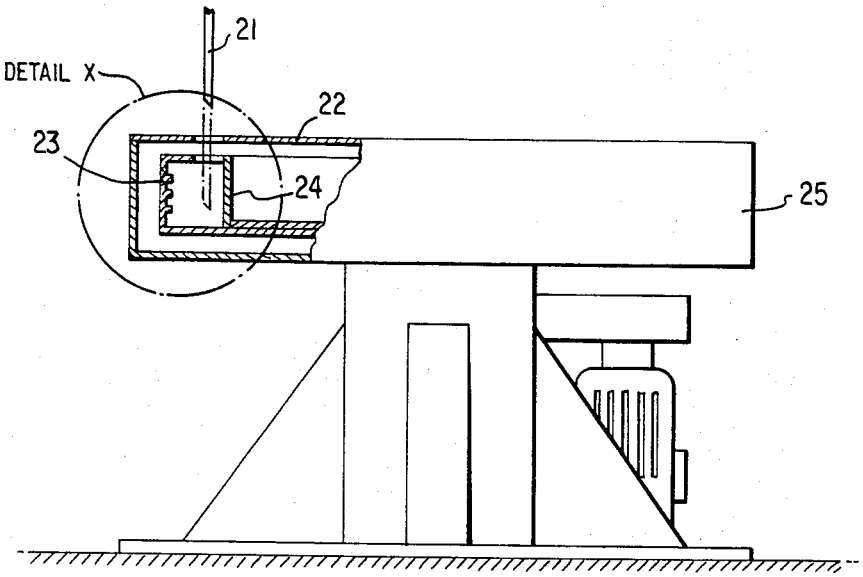
FIG. 7 is an elevational side view in partial cross section of a centrifuge for implementing the process for manufacturing a grinding element according to FIGS. 1 through 6.

FIGS. 1 and 2 show a grinding element according to the invention which includes a layer 11 of a hardened mixture of binder and abrasive grit, a supporting layer 12 formed of a foamed elastomer and a further layer 13, which is preferably a fabric, particularly a fabric of textile fibers.

Layer 11 of the mixture of binder and abrasive grit is provided with recesses 11*a* such that layer 11 rests on the elastomer supporting layer 12 in the form of islands 11*b*. As shown in FIGS. 3–6, recesses 11*a* may be arranged so that islands 11*b* have the geometric configuration of, for example, diamonds, circles, squares or ovals.

The abrasive grit for layer 11 can be produced of any known hard substances, such as, for example, corundum, silicon carbide, boron carbide and other carbides, garnet, natural emery, glass meal, etc. To support the abrasive effect in various respects and to realize a sufficient volume in the active grinding surface for the removal of the chips, it is further recommended to incorporate grinding aids, such as, for example, pyrite, hollow sphere corundum, marble meal, kryolith etc., whose density should be at least 2 g/cm$^3$.

The binders employed are preferably cold hardening types, for example, polyurethanes that harden at room temperature. For difficult grinding jobs, it is also possible to use higher valent elastomers which harden in a warm environment, for example, warm-hardening polyurethanes, thiokols and other liquid prepolymers of elastomers.

The thickness of layer 11 of binder and abrasive grit depends on the surface area of the abrasive grit islands 11, but is preferably 10 to 50% of the maximum expanse (length of the edges or diameter) of the abrasive grit islands 11*b*.

In order to impart sufficient supporting elasticity to the grinding element according to the present invention, the thickness of the elastomer supporting layer 12 is at least 5 mm, and for most applications is 10 to 40 mm.

Width and number of recesses 11*a* are selected so that the surface area ratio of grit islands 11*b* to recesses 11*a* lies in a range from 1/1 to 20/1.

Supporting layer 12 is preferably made of foaming types of polyurethane or foaming thiokols.

The construction of the grinding element can be adapted to respective intended uses by employing different recipes for layers 11 and 12. For example, the binder recipe for abrasive grit layer 11 may include a relatively hard nonfoaming binder and a relatively soft set and/or foaming recipe may be used for elastomer layer 12. Advisably, the raw materials employed for layers 11 and 12 are the same or related to one another; for example, a relatively hard, nonfoaming polyurethane recipe and a softer, foaming polyurethane recipe, respectively. The same applies correspondingly for thiokols which are nonfoaming and whose hardness can be adjusted by means of epoxy resins for use in abrasive grit layer 11.

The grit content in grit layer 11 results in a hardness difference between grit layer 11 and elastomer layer 12. Thus, even if the same recipe is used for the binder in grit layer 11 and for elastomer layer 12, the difference in hardness will be 10 to 20 Shore-A points.

The process according to the present invention, as explained below, produces a gradual transition from hard to soft between layers 11 and 12 which avoids shrinkage stresses. The differences in hardness between grit layer 11 and elastomer supporting layer 12, however, should not be too great. If elastomer layer 12 has a Shore-A hardness of 30, grit layer 11 should be set to Shore-A hardness of 80 to 85; with a hardness of Shore-A 60 in elastomer layer 12, the hardness of grit layer 11 may lie at Shore-D 80.

By selecting suitable abrasive grit sizes and binder recipes, and dimensioning the relative size of the abrasive grit islands 11*b* in a relationship to the recesses 11*a* in the abrasive layer 11, an elastic grinding element can be produced which, with respect to its service life and its capability to follow the shape of the workpieces being machined, can be used in all industrial applications.

Figure 8:
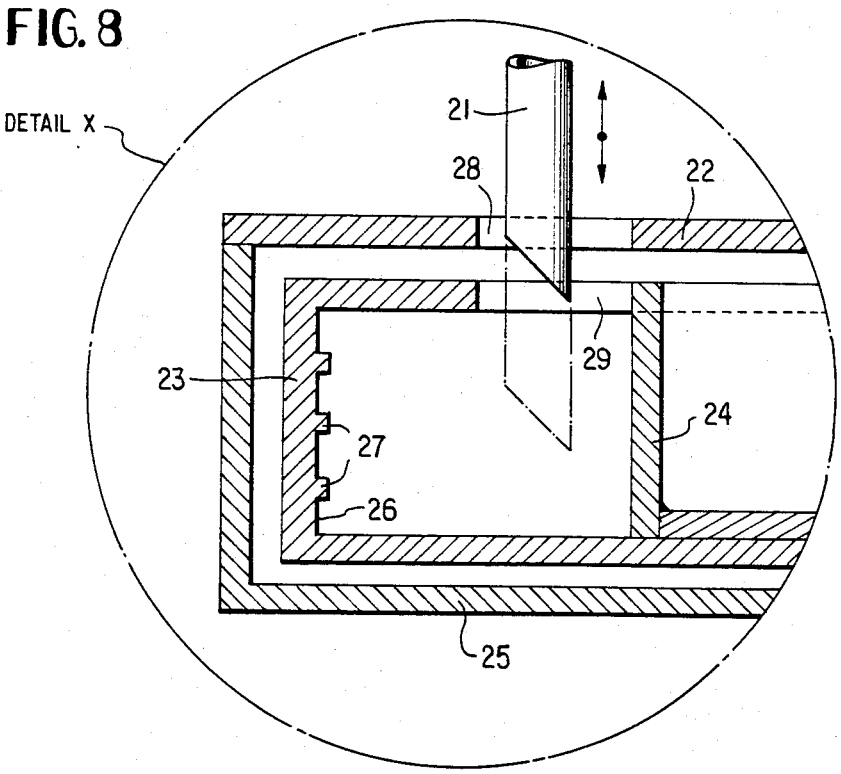
FIG. 8 is a cross-sectional view of a detail X of FIG. 7.

The process according to the present invention for producing a grinding element will now be explained in connection with the apparatus shown in FIGS. 7 and 8.

This apparatus includes a centrifuge in which a mold 23 is shaped for accommodating the components of the mixture for the grinding element. Mold 23 rotates within a protective hood 25 having a cover 22. An internal ring 24 defines the volume of the grinding element by providing an inner radius barrier for mold 23.

Mold 23 includes an end member 26 provided with appropriate ribs 27 or projections which are complementary with the desired surface structure of the grinding element, for example the various geometric configurations of grit islands 11*b* and recesses 11*a* shown in FIGS. 3 to 6.

The process according to the invention, in its simplest form, provides that the entire mixture used to produce the two layers 11 and 12 is applied to mold 23 when the centrifuge rotates. This causes the abrasive grains and grinding aids, if included, both of which have a heavier specific weight compared to the elastomer binder, to be concentrated in the active grinding surface. The specifically lighter, possibly foaming elastomer which is free of abrasive grit develops in a direction opposite to the direction of the centrifugal force so that the two layers 11 and 12 form a gradual transition.

The magnitude of the centrifugal force and thus the rate of rotation of the centrifuge depends on the viscosity and the pot life as well as the foam pressure of the elastomer employed.

Depending on the type and composition of the mixture, accelerations on the order of magnitude of 3 to 6800 g, and generally in a range from 150 to 2500 g are required to produce the grinding element according to the present invention.

According to a preferred embodiment of the process according to the present invention, however, the grinding element is produced in two steps. An axially displaceable fill pipe 21 is introduced into the cavity intended for the formation of the grinding element through an opening 28 in cover 22 and an annular opening 29 in mold 23 formed between end member 26 and inner ring 24. Preferably openings 28 and 29 are located so that opening 29 is spaced from end member 26. Initally, a measured quantity of a mixture of abrasive grit and binder is introduced through fill pipe 21. The mold is rotated in the centrifuge so that the mixture of abrasive grit and binder is smoothed against end member 26. Immediately thereafter, and advantageously by means of a conventional automatic dosaging machine equipped with a mixing head, the necessary quantity of the grit-free elastomer (later supporting layer) is injected through fill pipe 21. The binder containing the abrasive grit may, in principle, have the same composition as the grit-free elastomer mixture employed to produce the supporting layer. The former, however, is free of foaming agent, while the latter contains a foaming agent. Or, for example, by the addition of a cross-linking agent, the binder containing the abrasive grit can be set harder (to produce layer 11) to thus increase the machining output of the finished grinding element.

Advantageously the grit-free elastomer mixture is applied to the mixture of grit and binder before it hardens. This not only simplifies manufacture of the grinding element according to the present invention, but it also produces a gradual and stress-free hardness transition from layer 11 containing the abrasive grit to elastomer layer 12 which is free of grit and softer, this transition being supported by the gradient of centrifugal force which decreases toward the center of rotation of the centrifuge.

Preferably the mixtures introduced into the centrifuge will not completely harden under the influence of acceleration. For the wheel-shaped grinding element mold shown in the illustrated embodiment, the acceleration can be lowered after a certain period of time from a range of 153 to 2446 g to a range of 2.7 to 153 g, after which centrifuging continues until the mixture, although still sticky is sufficiently firm. The mold is then removed and the grinding element can be permitted to continue to harden, possibly under the influence of heat.

The process according to the present invention permits internal ring 24 to be constructed as a reusable mandrel which can be made of any desired hard material. Its circumferential face is preferably freshly ground and possibly roughened and/or provided with an adhesion imparting primer.

Ring 24 designed in this manner is then provided, before the mold is filled, with a coil of open-meshed glass fiber fabric 13 (FIG. 2) which has possibly been provided with an adhesion imparting medium so that this fabric coil becomes an integral component of the resulting grinding element. Fabric 13 may also be a nonstretchable fabric, web, etc. of other textile fibers.

There thus exists the possibility of clamping the grinding element as a wheel to a suitable drive available to the user without the grinding element ring expanding or breaking during work.

When grinding elements are produced in wheel form, as shown in the drawing Figures, excess foam of the elastomer may project through opening 29 beyond the edge of the mold during manufacture. This excess foam, however, can easily be cut off with a knife before the mass is removed from the mold and finish hardened.

The grinding element according to the present invention and the process of manufacturing it have been described above for the embodiment of a grinding element in the form of a wheel. However, grinding elements can also be produced in different shapes, for example a disc (FIGS. 13, 14) the grinding humps being located on one of the planar sides. In the latter case, the required molds 23*a* are suspended in a carusel-like centrifuge 25*a* so as to be rotatable, giving the centrifugal force an effect also in the axial direction X—X of the grinding element (FIG. 14) thus pressing the mixture against the bottom of mold 23*a* whereribs 27*a* are located to form the islands 11*b*.

When grinding elements are produced in the form of a disc, it is possible to limit the foaming of the grit-free elastomer toward the center of rotation, but due to the simple design of the apparatus, it may also be permitted to foam freely. In such cases, the grinding element must subsequently be plane ground. To fasten the thus obtained grinding disc on a support, a double-faced adhesive foil can be employed.

In the production of grinding discs, it is likewise not necessary to let the mixtures employed harden until they can be removed from the mold or to keep them under the influence of full acceleration. Depending on the size of the grinding element, the degree of acceleration, viscosity, pot life and other parameters, a period of 30 to 180 seconds of centrifuging time is generally sufficient for the mixture dispersion in the disc structure to stabilize enough that the mold can be removed. The mold must be set down horizontally until the binders have hardened sufficiently, and a heat treatment for final hardening may take place simultaneously or subsequently.

It has been found that the above-described grindind elements can also be produced in another way which results in considerable advantages with respect to production costs an increased grinding output.

This latter embodiment of the inventive method for producing the grinding elements according to the present invention is based on a planar negative mold 14 (FIGS. 9 and 10) which corresponds to the development of the finished grinding wheel. The width of the planar mold corresponds to the width of the grinding wheel to be produced and the length of the planar mold corresponds to the circumference of the grinding wheel.

In the simplest case, the planar negative mold 14 comprises an elastomer molding material, for example silicone rubber. To produce a grinding element having islands 11*b* according to the invention, mold nests 14*b* corresponding to the desired geometrical shape if islands 11*b* are provided in the planar mold 14. The mold nests 14*b* are filled with a highly viscous and/or thixotropic mixture of abrasive grit and binder or such a mixture is spread thereinto. The mold 14 is then rolled into a circle and placed into the centrifuga ring mold 23 the plan surface of mold 14 being located against the end member 26, which doesn't have ribs in this case, as islands 11*b* are already formed by mold 14. An elastomer is next poured in while the mold is under rotation or alternatively foamed in and thereafter hardened, to form supporting layer 12.

A variation of this process is based on a rigid planar negative mold 14. The mold material in this case may be a metal; however, most expediently a material is employed which makes the production of such molds more economical. For example, plaster of paris, concrete, epoxy resin, polyester resin and deep-drawn foils are suitable for this purpose.

To produce a grinding element in the shape of a wheel according to this variation of the inventive process, the rigid mold nests 14*b* are provided with a suitable separating agent and are again filled with the mixture of abrasive grit and binder until this mixture is flush with the surface of the mold. Thereafter, a carrier material 15 of corresponding dimensions is placed thereonto.

Suitable carrier materials are, for example, paper, foils, nonwoven fabrics, woven fabrics, knit fabrics or the like.

The carrier material must be firmly bonded to the mixture of abrasive grit and binder in the mold nests. For this purpose the carrier material may be coated with an appropriate adhesive material if the inherent adhesion of the mixture of abrasive grit and binder in the mold nests does not suffice for this purpose. Suitable separating agents are silicone-oil or TEFLON-Spray, polyurethane-components can be used as adhesive material.

After the mixture of abrasive grit and binder in the mold nests has hardened, possibly unter the influence of heat, the carrier material is removed from the mold together with the firmly adhering grinding humps (islands 11*b*) and is then placed into the centrifugal ring mold 26, with the humps against the end member 26, which again doesn't require any ribs, as islands 11*b* were already formed by planar mold 14. An elastomer is thereafter poured in or foamed in as described above.

It is, of course, also possible to first harden the mixture of abrasive grit and binder and then apply the carrier material via a permanent adhesive.

The following advantages relative to production costs result from this method utilizing planar negative molds:

1. The carrier strips with the firmly adhering grinding humps (FIG. 11) can be manufactured in advance, stored and later bonded to a poured or foamed elastomer material to become more or less hard or elastic, as requested by the customer.

2. A planar mold is less expensive to produce than a corresponding ring mold.

3. The necessary centrifugal accelerations are less, so that the centrifuges can be of a lighter weight. It is even possible to operate completely without the use of centrifuges.

The advantages with respect to increasing the grinding output are evident from the fact that binders can be used for the grinding layer and the the elastomer layer which could not be combined in the first described ebodiment of the inventive process. For example, the use of planar negative molds according to the latter embodiment of the inventive method allows the use of phenol resins as binders for the abrasive layer, i.e., binders which are known to produce high removal rates per unit time.

The following examples will demonstrate how the invention explained above in a general manner can be used for the production of specific grinding elements.

The grinding element according to the first example is wheel-shaped and has a diameter of 450 mm and a width of 150 mm and can be used for grinding high-quality steel tubes for example dairy-farms or swimming-pools.

According to the dimensions of this grinding element, mold 23 has an inner diameter of 450 mm, ribs 27 have a height of 20 mm resulting in a thickness of grit layer 11 of 20 mm, islands 11*b* are shaped according to FIG. 3. Mandrel 24 has an outer diameter of 390 mm and a width of 170 mm, resulting in a total thickness of the grinding element of 450 mm−390 mm=60 mm. Mandrel 24 is provided with a double-coil of glass fiber fabric, establishing layer 13 of the grinding element.

The components of grit layer 11 are white high-quality corundum, polyurethane binders ERCEPUR KE 5266, RHENODUR C 110 and DABCO 33 LV in a relative composition of 300:100:88:0.3, resulting in a hardness of shore D 40.

The components of elastomer layer 12 are polyurethane compositions ERCEPUR KE 6985, ERCEPUR KE 5196 and FRIGEN R 11 in a relative composition of 100:48:10, resulting in a hardness of shore A 60.

4.1 kp of the components of grit layer 11 (average density=2.5 g/cm$^3$) are successively filled into a mixer; the resulting mixture is then injected through fill pipe 21 into mold 23, the mold rotating at 1400 rotations/minute. At the same time 3.0 kp of the components of layer 12 are prepared:ERCEPUR KE 6985 is filled in a mixer and FRIGEN R 11 is added thereafter into the fast rotating mixer, at last ERCEPUR KE 5196 is added and the mixture is mixed intensively. Immediately thereafter (15–20 seconds) this mixture is injected through fill pipe 21 while mold 23 still under rotation at 1400 rot./min. Having finished the injection, rotation frequency is lowered to 350 rot./min. and kept for 2 minutes. Then the centrifuge is turned off and after a period of 3 minutes the grinding element can be removed from mold 23.

The grinding element due to the second example described below is also wheel-shaped with a diameter of 470 mm, and can preferably be used for grinding tubes of extremely hard materials such as heat-exchanger tubes in nuclear power stations.

A planar mold 14 (FIG. 9) is made of silicone rubber having a width of 115 mm, a length of 1415 mm (470 m$\times\pi$) and a thickness of 20 mm, recesses 14*b* being 10 mm deep.

The components of grit layer 11 are dark red high-quality corundum, epoxy-resin VE 2841, hardener HE 105-B and silicone-adhesive GF 91 in a relative composition of 300:17.5:7.8:0.2.

The components of elastomer layer 12 are identical to those desribed in the first example.

4.5 kp of the components of grit layer 11 are intensively mixed resulting in a substance showing high viscosity. This mixture is then applied to the recesses 14*b* of mold 14 until it is flush with the surface of mold 14. Filled mold 14 is then rolled into a circle and placed into ring mold 23 of the centrifuge, the filled recesses 14*b* directed to the center of mold 23. Thereafter mold 23 rotates (700 rot./min.) and the mixed components of layer 12 are injected through fill pipe 21. After injection mold 23 continues rotation for 5 minutes (300–400 rot./min.) and is then turned off. The grinding element and mold 14 are removed from mold 23 and are secured together by an outer ring. Finally, the ensemble grinding element/mold 14 is placed in an oven and hardened at 80° Celsius for a period of 2 hours.

The components indicated above for grit layer 11 and elastomer layer 12 are in commercial use and may be bought from:

"Rhein-Chemie" in Mannheim-Rheinau, West Germany (ERCEPUR, RHENODUR)

"Bakelite GmbH" in Lethmathe, West Germany (epoxy de-resin Ve 2841, HE 105-B)

Air Products and Chemicals, Inc.; Box 538, Allentown, Pa. 18105, USA (DABCO 33 LV)

E. J. du Pont de Nemours and Co. Inc. (FRIGEN) 1007, Market Street, Wilmington USA "Wacker" in Munich, West Germany (Silicone adhesive GF 91)

It will be understood that the above description of the present invention is susceptible to various modifications, changes and adaptations, and the same are intended to be comprehended within the meaning and range of equivalents of the appended claims.

What is claimed is:

1. A process for producing an elastic grinding element for form-true grinding, wherein the element includes a supporting layer of elastomer material and an abrasive grit layer bound to the supporting layer and having an active grinding surface made of a hardened mixture of binder and abrasive grit, said process comprising:

providing a mold having a shape constructed to produce a desired shape for the grinding element;

putting the mixture of binder and abrasive grit and the elastomer material into the mold;

providing a rotating system;

disposing the mold in the rotating system; and subjecting the mold with the mixture of binder and abrasive grit and the elastomer material therein to a centrifugal force via the rotating system.

2. A process as defined in claim 1, wherein the rotating system is a centrifuge.

3. A process as defined in claim 2, wherein the centrifuge has an outer wall, the desired shape of the grinding element is the shape of a wheel and further including placing the mold adjacent the outer wall of the rotating centrifuge.

4. A process as defined in claim 3, including disposing a circular ring shaped core in the centrifuge so that the axial axis of the ring shaped core is coaxial with the axial axis of the mold.

5. A process as defined in claim 2, wherein the mold has an outer radius, said putting step includes providing a fill pipe which is displaceable in a direction parallel to the axis of rotation of the centrifuge, arranging the mold and centrifuge for receiving an end of the fill pipe, extending the fill pipe into the mold, and successively injecting the mixture of binder and abrasive grit and a mixture for the supporting layer of elastomer material in measured amounts through the fill pipe while holding the fill pipe at a distance from the outer radius of the mold.

6. A process as defined in claim 5, wherein said subjecting step includes accelerating the mixture of binder and abrasive grit before injecting the mixture of elastomer material and said injecting step includes injecting the mixture for the layer of elastomer material before the mixture of binder and abrasive grit has hardened.

7. A process as defined in claim 5, including bringing the centrifuge to a halt when the mixture of binder and abrasive grit and of the elastomer material is sufficiently shape retaining, removing the grinding element from the mold and subsequently permitting the grinding element to finish hardening.

8. A process as defined in claim 5, wherein said subjecting step includes controlling the rate of rotation of the centrifuge such that radial accelerations in a range from about 3 g to about 6800 g develop in the area between the fill pipe and the outer radius of the mold.

9. A process for producing an elastic grinding element for form-true grinding, wherein the element includes a supporting layer of elastomer material and an abrasive grit layer bound to the supporting layer and having an active grinding surface made of a hardened mixture of binder and abrasive grit, said process comprising:

providing an elastic planar mold having a shape constructed to produce a desired shape for the grinding element;

prefabricating the abrasive grit layer with an active grinding surface by putting a mixture of binder and abrasive grit in the elastic planar mold;

rolling the elastic planar mold into a ring shape with the abrasive grit layer disposed therein; and providing the prefabricated abrasive grit layer with a ring-shaped carrier layer of elastomer material.

10. A process for producing an elastic grinding element for form-true grinding, wherein the element includes a supporting layer of elastomer material and an abrasive grit layer bound to the supporting layer and having an active grinding surface made of a hardened mixture of binder and abrasive grit, said process comprising:

providing a rigid planar mold having a shape constructed to produce a desired shape for the grinding element;

prefabricating the abrasive grit layer with an active grinding surface by putting a mixture of binder and abrasive grit in the rigid planar mold and bonding a carrier material to the abrasive grit layer in the rigid planar mold;

removing the abrasive grit layer along with the carrier material from the rigid planar mold and placing it into a ring mold; and providing the prefabricated abrasive grit layer with a ring-shaped carrier layer of elastomer material.

* * * * *